United States Patent [19]

Lange et al.

[11] 4,249,078

[45] Feb. 3, 1981

[54] ARRANGEMENT FOR THE PRODUCTION OF ELECTRORADIOGRAPHIC X-RAY PHOTOGRAPHS

[75] Inventors: Gottfried Lange, Erlangen; Hans Heinrich, Buckenhof, both of Fed. Rep. of Germany

[73] Assignee: Siemens Aktiengesellschaft, Berlin & Munich, Fed. Rep. of Germany

[21] Appl. No.: 34,121

[22] Filed: Apr. 27, 1979

[30] Foreign Application Priority Data

May 5, 1978 [DE] Fed. Rep. of Germany ..... 2819864

[51] Int. Cl.[3] ..... G03G 13/00; G03G 15/00

[52] U.S. Cl. ..... 250/315.2; 250/315.1

[58] Field of Search ..... 250/315, 315 A, 315.1; 355/3 R

[56] References Cited

U.S. PATENT DOCUMENTS 2,802,949 8/1957 Lehmann ..... 250/315 A 3,922,547 11/1975 Provdian et al. ..... 250/315 A

FOREIGN PATENT DOCUMENTS 2601039 7/1977 Fed. Rep. of Germany .

1772469 8/1977 Fed. Rep. of Germany .

*Primary Examiner*—Alfred E. Smith

*Assistant Examiner*—Thomas P. O'Hare

*Attorney, Agent, or Firm*—Hill, Van Santen, Steadman, Chiara & Simpson

[57] ABSTRACT

The invention relates to arrangements for the production of electroradiographic x-ray photographs wherein x-ray photoconductive layers are electrically charged at their surfaces and subsequently exposed to an image-forming irradiation with x-rays, such that, due to the influence of the rays which penetrate a body, charge images are obtained which can be rendered visible through the application of pigment particles. For the simultaneous production of several images, the invention provides that several layers be arranged in a cassette. An inventive arrangement is particularly suited for use in medical radiation diagnosis.

9 Claims, 2 Drawing Figures

ARRANGEMENT FOR THE PRODUCTION OF ELECTRORADIOGRAPHIC X-RAY PHOTOGRAPHS

BACKGROUND OF THE INVENTION

The invention relates to an arrangement for the production of electroradiographic x-ray photographs according to the preamble of patent claim 1. Such arrangements are e.g. known from the U.S. Pat. No. 2,802,949.

Photoelectric exposure plates for x-ray images consist, as is known, of semiconductor layers which are applied onto an electrically conductive carrier. They are electrically charged and then exposed in a light-proof cassette to the influence of the radiation from which an image is to be formed. Finally, there remains on the surface of the photoconductive layer an electrostatic image. To avoid loss of image charge, an electrically insulating space is provided between the charged surface and the cassette lid. However, if this space is filled with air or another gas, an ionization is brought about during the irradiation which causes a reduction in the charge of the latent image at its edges on the photographic layer (ionization-induced undercutting). Moreover, due to the intermediate air space, a substantially thicker cassette is required than in the case of photofilms e.g. vacuum-packed "low-dose-systems".

SUMMARY OF THE INVENTION

The object underlying the invention is, in the case of an arrangement for the production of electroradiographic x-ray photographs according to the preamble of claim 1, to largely eliminate the intermediate air space. This object is achieved in accordance with the invention by the measures disclosed in the characterizing portion of this claim.

Through the utilization of two photoconductor surfaces facing one another, which can be charged, the loss of charge from each surface to the surroundings is avoided with certainty. This is based on the fact that the two surfaces are similarly charged and can be at approximately the same potential, on the one hand, and that, during the passage of x-rays at respective oppositely disposed locations of the charged surfaces, similar variations in the charge result, on the other hand. However, this signifies that the otherwise necessary, relatively large spacing of a confronting surface, to an extent which is necessary for the mutual electric separation, can be reduced. The extent of required separation is conditioned, in the case of the semiconductor layers conventional in electroradiography—as a rule, selenium layers—essentially by the necessary high electrostatic charges of the photoconductive surfaces. Therefore, in contrast with the conventional cassettes wherein at least 5 to 10 mm intermediate space is adhered to, 0.1 to 5 mm, to particular, about one millimeter (1 mm) should be sufficient, because equal charge levels (potentials) are disposed opposite one another. The air space over the charged surface is, as a consequence, reduced on the average to an extent of approximately one millimeter (1 mm). This signifies that the otherwise approximately 18 mm-thick cassettes need now only be made 3 to 5 mm thick, so that the advantage is achieved that the cassettes are easier to handle and that they enter easily onto the cassette receiving installations of the x-ray apparatus. Moreover, through the reduction of the spacing, the ionizable quantity of gas which is disposed in front of the charged surfaces is substantially reduced, such that an otherwise interfering effect of ions does not occur.

Moreover, in the case of an irradiation with x-rays, two electrostatic irradiation (or transmission) images can be simultaneously obtained. The latter can be rendered visible in various ways; i.e. by various development processes. The first of a pair of charge images can be developed as a proportional-image; i.e., in the form of an optical photographic film-equivalent image. The second charge image can then be developed pursuant to edge emphasis; i.e., emphasizing particularly minimal radiation contrast differences.

Through the arrangement of several image receivers behind one another in tandem, a very high percentage of incident x-rays can be absorbed and utilized for the purpose of image-formation. This is particularly of significance in the case of the conventional x-ray exposure voltages which are utilized in xeroradiography, and which lie between 80 and 125 kV, because, in the case of the conventional selenium layer thicknesses of 150 to 300 microns (150 to 300 $\mu$m), only a portion of the x-ray quanta is absorbed in one layer.

The arrangement of two oppositely disposed semiconductor plates can be supplemented in a simple fashion for improving the radiation utilization and for simultaneously obtaining additional simultaneous photographs, said supplementation proceeding by the interposition of one or more additional plates which consist of a radiolucent carrier, for example aluminum- or carbon-fiber plates, which are covered on both sides with the semiconductor layer, for example of selenium.

Particularly when several layers are utilized, it is expedient to coordinate their thicknesses with one another in order to make allowance for the absorption of the radiation in the tandem- (or successively) disposed layers. If they consist of selenium and are utilized for conventional x-ray photographs, they should have a thickness of approximately 100 to 500 microns. One must proceed here on the basis that rays are already absorbed in the first layer and that only the remainder is available for the remaining layers. The latter is then, as in the first layer, attenuated in each additional layer by the radiation quantity absorbed therein. The adaptation to the decreasing radiation quantity, with regard to equal absorption in every layer, can proceed in the manner conventional in the case of conventional film-intensifier foil-simultaneous photographs. As in that case, the layers can be made thicker with increasing distance from the radiation source, corresponding to the reduction in the radiation density.

An additional adaptation to the utilized radiation quality should take place. In the case of soft x-radiation (for example, mammography), a different adjustment is necessary than in the case of hard x-radiation (extremities, skull, etc.). In the first instance; i.e., in the case of 25 to 45 kV and to selenium layers, the first layer in the radiation direction should be approximately 150 microns (150 $\mu$m) thick and the second layer about 300 microns (300 $\mu$m) thick; and, in the second instance, a range of 200 to 500 microns (200 to 500 $\mu$m) would include the thicknesses of the two layers. In the case of several layers, the rule applies that thinner layers lie at the radiation-incident side of the arrangement, and that the following are thicker; for example, the layers may be graduated in groups, or may increase from layer to layer with an increasing distance from the radiation source. This results, in the case of 100 kV and four layers, in a first layer of, for example, 150 microns; a second layer of 200 microns; a third layer of 200 microns; a fourth layer of 300 microns μm. The distance (or spacings) should all be the same and amount to from one to five millimeters (1 to 5 mm).

The development of the individual images can proceed in the manner known from xerography, for example, by means of powder clouds or utilizing a liquid suspension of toner particles. Also, in the remaining processing of the exposure plates, nothing is changed, so that the basic method sequence is maintained. As is known, the latter presents itself such that first and free surface of the plate is charged, then the x-ray exposure takes place, and finally, the image development and, possibly, a transfer of the image to another carrier. Following a cleansing, the exposure plate can again be introduced into the photographic exposure cycle; i.e., it is again available for the production of new x-ray images.

Further details and advantages of the invention will be explained in the following on the basis of the exemplary embodiments illustrated on the accompanying sheet of drawings; and other objects, features and advantages will be apparent from this detailed disclosure and from the appended claims.

DETAILED DESCRIPTION

Figure 1:
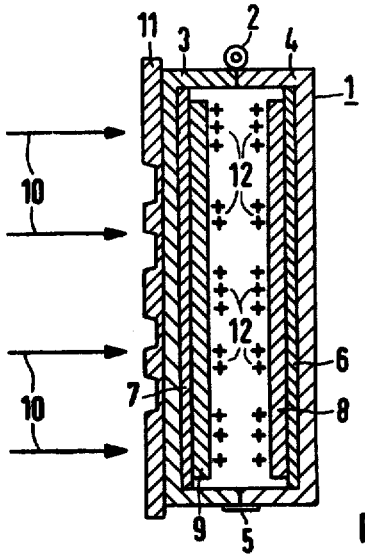
FIG. 1 schematically illustrates an x-ray cassette in which two x-ray photosemiconductors are housed opposite one another.

In FIG. 1, an x-ray cassette consisting of plastic, or aluminum, respectively, is referenced by 1 which consists of two half-box-like parts 3 and 4 which can be swung open on a hinge joint 2, which parts 3 and 4 can be connected with one another in a lightproof fashion by means of a closure 5. On the interior wall of the two parts 3 and 4, respectively, a carrier 6 or 7, respectively, is disposed, on which a selenium layer 8, or 9, respectively, is applied, with the free surfaces of layers 8 and 9 facing one another over the entire areas thereof.

In the case of incidence of x-rays which are indicated in FIG. 1 by arrows 10, the x-ray photograph takes place in a manner known per se. The rays penetrate first a body 11 to be examined. The latter manifests, in the direction of the rays 10 penetrating it, different thicknesses at various locations. Correspondingly, different quantities are discharged of the positive charge applied on the facing free surfaces of the layers 8 and 9, as indicated by the symbols (+) at 12. This distribution of the charge—corresponding to the density image of the body 11—at the surfaces of the layers 8 and 9 is then developed in the manner conventional in the case of xerography.

Figure 2:
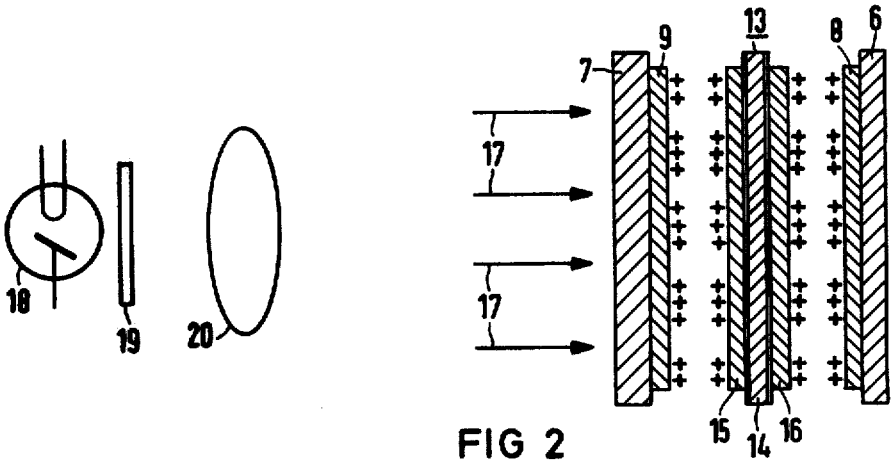
FIG. 2 illustrates the principle of an arrangement in which an additional double layer plate is placed between the two x-ray photosemiconductor plates according to FIG. 1

In the arrangement indicated in FIG. 2, which may be enclosed in a cassette, in the manner shown in FIG. 1, an additional plate 13 is arranged between the free surfaces of the layers 8 and 9. It consists e.g. of a carrier 14 of graphite which is 1.5 mm thick. The graphite carrier 14 carries at both sides a layer of selenium, such layers being e.g. 200 microns thick each, whereas the layers 9 and 8, as in the case of the embodiment illustrated in FIG. 1, are e.g. 100 and 500 microns thick respectively, the carrier 7 consisting of 1.5 mm thick graphite, and the carrier 6 consisting of 2 mm thick sheet aluminum. For the photographic exposure of fluoroscopy images, e.g. with an arrangement according to FIG. 2, as is known, the basic magnitudes to be selected with respect to radiation are prescribed; i.e. in the case of utilization of an x-ray tube 18 as the radiation source, the high voltage (kV) to be applied and the filters 19 (material and thickness) to be interposed in series in the radiation path of the tube. This is the prerequisite for being able to obtain usable images in the case of irradiation of a body 20. In addition, however, the layer thicknesses d of the layers 8, 9 and 15, 16; the charge thereon (measured as a potential V in volts); and, in view of their properties (sensitivity E), also the voltage reduction dU during the exposure with regard to the reduction of the charge potential V, to be expected during the photographic exposure, are freely selectable. It must be noted here that the voltage reduction is intended to approximately obey $dU=E\ (D-dD_{abs})$ where D is the incident dose and $dD_{abs}$ is the dose reduction which occurs in the first plate during the exposure (the geometric attenuation of the radiation occurring over the distance from the radiation source can be neglected here on account of the small distances involved).

The photographic exposure proceeds in the manner known per se, already indicated with regard to FIG. 1, by means of irradiation of x-rays which are indicated by arrows 17. The sole difference consists in that charge images are additionally obtained on the free surfaces of the layers 15 and 16.

The foregoing description under the heading Summary Of The Invention is hereby specifically incorporated into the detailed description and applied to each of the foregoing embodiments except as otherwise indicated herein. Thus, for example, the spacings between the symmetrically charged surfaces in FIGS. 1 and 2 are in the range between about 0.1 mm and five millimeters, and generally about one millimeter. In FIG. 1, the cassette may have a thickness of from three to five millimeters, while the corresponding cassette for enclosing the parts of FIG. 2 may have a thickness of from six to eight millimeters, for example.

The various features of each embodiment of the specification and claims are hereby specifically disclosed as applicable to each of the other embodiments herein. Thus, for example, in the embodiments of FIGS. 1 and 2, the radiolucency of the carriers may be graduated so that at least the carrier 7 which lies closest to the radiation source consists of carbon, and the carrier 8 which is farthest removed from the radiation source consists of sheet aluminum. In each of the embodiments, the chargeable surfaces may be arranged at a spacing from one another in the range from one to five millimeters, particularly two millimeters.

It will be apparent that many modifications and variations may be effected without departing from the scope of the novel concepts and teachings of the present invention.

We claim as our invention:

1. An arrangement for the production of electroradiographic x-ray photographs wherein a photoconductive exposure plate has a chargeable surface, which can be electrically charged, is exposed in an image chamber to the influence of a radiation image from which a charge image is to be formed, characterized in that, opposite the chargeable surface, an additional surface is disposed, the two surfaces being at least approximately similar in charge retention characteristics, and further characterized in that the two surfaces are the free surfaces of respective photoconductive layers of xeroradiographic exposure plates which are known per se.

2. An arrangement according to claim 1, characterized in that photoconductive layers provide plural pairs of confronting surfaces in tandem, at least one exposure plate having photoconductive layers with a chargeable surface on both sides thereof.

3. An arrangement according to claim 1, characterized in that a photoconductive layer which is further removed from the irradiation source is thicker than a photoconductive layer arranged more closely to said source.

4. An arrangement according to claim 2, characterized in that the respective pairs of confronting surfaces are provided with substantially corresponding charges thereon and are arranged at successively increasing distances from an irradiation source, the photoconductive layers which are further removed from the irradiation source being thicker than the photoconductive layer closest to said irradiation source.

5. An arrangement according to claim 2, characterized in that progressively thicker photoconductive layers are arranged in dependence upon their distance from a radiation source.

6. An arrangement according to claim 3, characterized in that each photoconductive layer comprises selenium as the semiconductor, and has a thickness in the range from about 100 to 500 microns.

7. An arrangement according to claim 1, characterized in that in the case of utilization of photoconductive layers which are applied on a carrier, the radiolucency of the carriers is graduated in that at least the carrier which lies closest to the radiation source consists of carbon, and the carrier which is furthest removed from the radiation source consists of sheet aluminum.

8. An arrangement according to claim 1, characterized in that the chargeable surfaces are arranged spaced from one another by a distance in the range from 1 to 5 mm, particularly 2 mm.

9. An arrangement according to claim 1, characterized in that the construction of the photoconductive layers is selected at least approximately corresponding to the formula $dU=E\ (D-dD_{abs})$, wherein dU is the voltage reduction in the respective layer; E the sensitivity of the layer; D the incident dose; and $dD_{abs}$ the dose reduction by the first layer.

* * * * *